United States Patent [19]

Valantin

[11] 3,990,349

[45] Nov. 9, 1976

[54] DEVICE FOR EFFECTING TRANSLATIONAL MOVEMENT OF A MACHINE

[75] Inventor: Alfred A. M. Valantin, Clermont (Oise), France

[73] Assignee: Charbonnages de France, Paris, France

[22] Filed: Apr. 1, 1975

[21] Appl. No.: 564,081

[30] Foreign Application Priority Data

Apr. 8, 1974 France ..... 74.12240

[52] U.S. Cl. ..... 91/178; 61/45 D; 91/191; 91/280; 91/353; 91/413; 91/461

[51] Int. Cl.[2] ..... F01L 15/18

[58] Field of Search ..... 91/411 R, 448, 413, 91/281, 316, 350, 353, 308, 311, 314, 191, 192, 193, 178, 280, 461

[56] References Cited

UNITED STATES PATENTS

| | | | |
|---|---|---|---|
| 2,112,466 | 3/1938 | Maloon | 60/471 |
| 2,833,556 | 5/1958 | Kling | 91/411 R |
| 3,348,624 | 10/1967 | Just | 60/484 |
| 3,476,016 | 11/1969 | Dixon | 91/411 R |
| 3,499,466 | 3/1970 | Chirco | 91/448 X |
| 3,564,842 | 2/1971 | Van Marle | 91/448 X |
| 3,620,014 | 11/1971 | Klein | 91/413 |
| 3,672,159 | 6/1972 | Sundin | 91/411 R |
| 3,724,333 | 4/1973 | Fonden | 91/413 |
| 3,815,472 | 6/1974 | Schante | 91/411 R |

FOREIGN PATENTS OR APPLICATIONS

| | | |
|---|---|---|
| 1,548,671 | 10/1968 | France |

*Primary Examiner*—Martin P. Schwadron
*Assistant Examiner*—Abraham Hershkovitz
*Attorney, Agent, or Firm*—Cushman, Darby & Cushman

[57] ABSTRACT

A hauling device, for example for a mining machine, has two clamping elements which grip on ramps each of which elements is attached to an operating rod of a hauling jack. The jacks are operated alternately, in conjunction with the clamping elements to advance or retract the machine, and the hauling jacks are hydraulically interconnected in a manner to avoid hunting.

7 Claims, 1 Drawing Figure

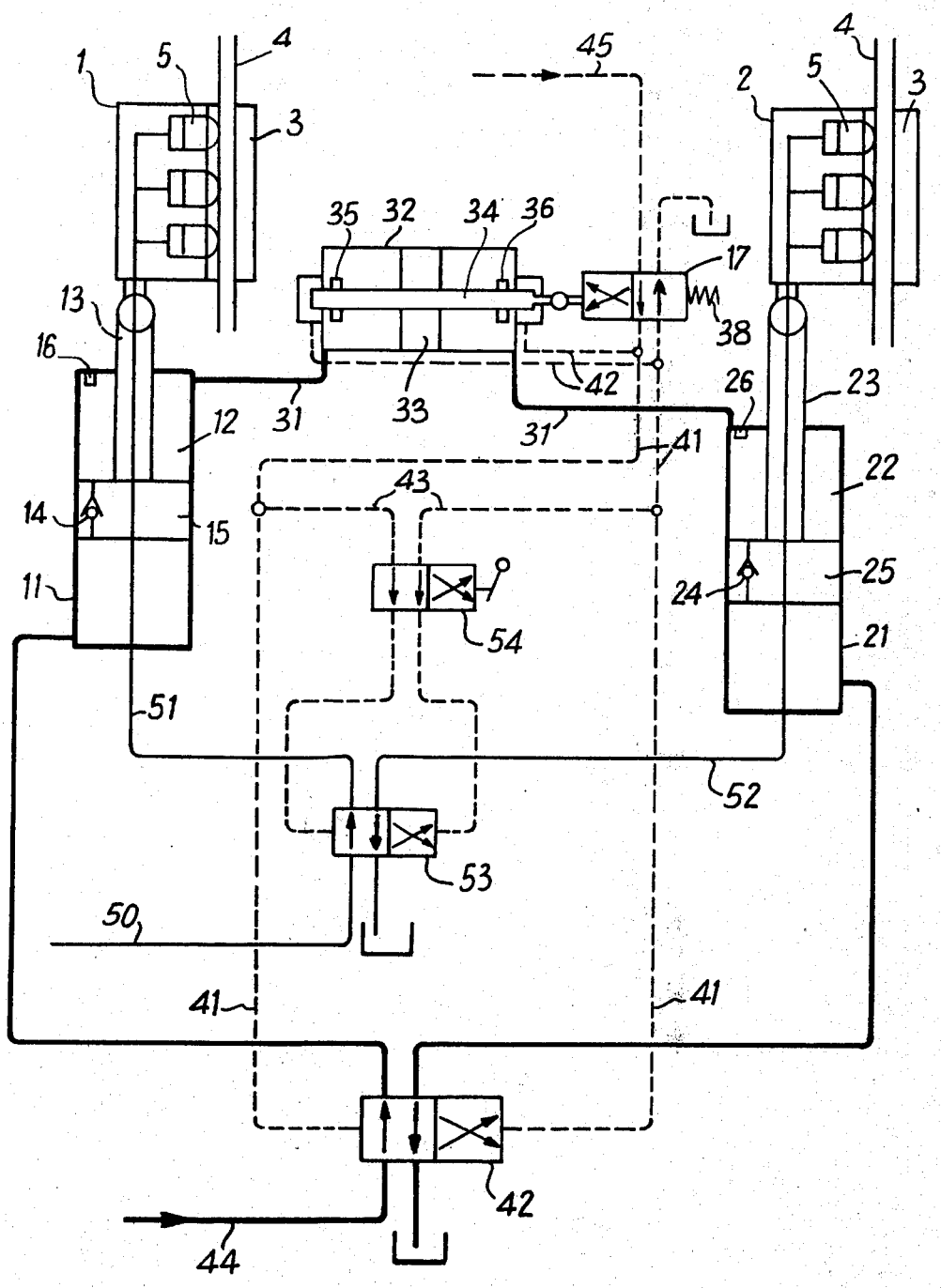
1
5
4
3
45
2
5
4
3
35
32
34
36
17
38
13
16
42
26
23
12
31
33
31
41
22
43
14
15
11
24
25
54
21
51
52
53
50
41
41
42
44

DEVICE FOR EFFECTING TRANSLATIONAL MOVEMENT OF A MACHINE

BACKGROUND OF THE INVENTION

1. Field of the Invention

The invention relates to a device for effecting translational movement of a machine comprising two anchoring elements on which the machine is supported, sometimes on one and sometimes on the other, the machine hauling itself by means of hauling jacks respectively connected to the anchoring elements.

2. Description of the Prior Art

French Pat. No. 1,548,671 describes a device for the translational movement of a mining machine which is hauled by means of two associated jacks on a gripping arrangement having two positions, one of which is a clamping position and the other a sliding position, these two positions being combined with the movements of extension and retraction of the jacks.

In this arrangement the jacks are connected both by their rods and by pipes.

This construction introduces a certain rigidity into the machine.

A main object of the invention is to permit a more flexible construction by eliminating any mechanical connection of the hauling jacks. For this purpose it might be conceivable to retain only the hydraulic connection. However damping effects are evident so that hunting occurs which is detrimental to the correct operation of the arrangement.

A further object of the invention is to eliminate these disadvantages and to permit the construction of a machine in which the jacks can be conveniently accommodated without being governed by their relative spacial dispositions.

Yet another object is to reduce as far as possible the hydraulic connections by flexible pipes, whose disadvantages are well known for machines which have to operate under very severe conditions and are subject to shocks and rock fall, as is the case with mining machines.

SUMMARY

A device for effecting translational movement of a machine includes two anchoring elements operated one at a time, usually alternately; which elements support the machine and are respectively connected to hauling jacks which have cylinders which are interconnected by a hydraulic connection and which have the same effective volume. The hydraulic connection is estabished through a free-piston hydraulic jack which has at least the same effective volume as the interconnected cylinders.

BRIEF DESCRIPTION OF THE DRAWING

An embodiment of the invention will now be described with reference to the accompanying drawing which illustrates a device according to the invention for the translational movement of an ore extraction machine along the ramp of an armoured conveyor.

DESCRIPTION OF THE PREFERRED EMBODIMENT

The machine illustrated has two gripping anchoring elements 1 and 2 comprising clamping jaws which engage a ramp 4 and which are hydraulically operated by jacks 5, as illustrated in FIGS. 19, 20 and 21 of French Pat. No. 1,548,671. These clamping elements will hereinafter be referred to as "gripper hands". Each gripper hand consists of a set of single-action jacks 5 and a hook 3 which surrounds the fixed ramp 4. When the jacks 5 are under pressure the gripper hand is clamped to the ramp, thus providing a fixed point. When the jacks 5 are not under pressure the gripper hand can slide on the ramp 4.

In order to haul the machine, two double-action jacks 11 and 21 are provided, which are identical and have pistons 15 and 25 connected by operating rods 13 and 23 to the gripper hands 1 and 2. The hauling jacks 11 and 21 are connected in series by hydraulic connection of cylinders 12 and 22 of small section, that is to say on the sides of the pistons 15 and 25 where the rods 13 and 23 are attached. The hydraulic connection includes a pipe 31.

In the pipe 31 there is connected an intermediate jack 32 having a free piston 33. In each of its end positions the free piston 33 defines in the cylinder of the jack 32 an effective volume which is at least equal to the effective volume of each of the cylinders 12 and 22 of the hauling jacks 11 and 21. The free piston 33 of the intermediate jack 32 is traversed axially by a central sliding rod 34 which acts as an end-of-stroke detector and which carries two stops 35 and 36 near and at a short distance from its ends. This central rod 34 controls an operating distributor 17 by thrust or by a return spring 38. When the larger face of the hauling jack 11 is loaded, oil contained in the cylinder 12 pushes the free piston 33 from left to right in the drawing. In the other chamber of the intermediate jack 32 the oil in turn pushes the piston of the hauling jack 21 in the opposite direction to that of the hauling jack 11. The sliding rod 34 is locked in its end positions by a branch 42 of an operating circuit 41 controlled by the operating distributor 17, which is an inversion distributor. The self-locking abutment force is smaller than the force acting on the free piston 33.

Valves 14 and 24 are located in the pistons 15 and 25 of the hauling jacks 11 and 21, which valves are opened by stops 16 and 26 at the end of the stroke on the side connected to the intermediate jack 32. The valves are also opened at the opposite end of the stroke through their non-return valve effect, thus effecting the additional filling of the useful volume developed by the corresponding hauling jack, so as to make up for variations in volume of hydraulic fluid on each side of jack pistons, thus avoiding the phenomenon of hunting.

When the free piston 33 of the intermediate jack 32 bears against the stop 35 or 36 of the sliding rod 34, the latter reverses the operating distributor 17 which, by means of the operating circuit 41, reverses the oil pressure distributor 42 supplying the hauling jacks 11 and 21.

Th clamping and unclamping of the gripper hands are controlled by hydraulic circuits 51 and 52 which are fed by a pressure line 50 and operated by a distributor 53 which is supplied by a branch 43 of the operating circuit 41. This branch 43 is controlled by a manual reversing selector 54. In order to avoid flexible connections, which are always vulnerable, it is advantageous that the pipes connecting the operating circuits 51 and 52 of the gripper hands 1 and 2 pass axially through the body and operation rod of each of the hauling jacks 11 and 21.

A hauling machine has the two hauling jacks 11 and 21 fixed on its body, with the operating rods connecting the machine to the gripper hands 1 and 2. The arrangement described so far operates in such a way that when one of the hauling jacks is extended the other is retracted, and vice versa. In order to operate the hauling jacks to achieve translational movement of the machine, the jacks are mounted on the machine with the two operating rods directed in the same direction.

The operation of this arrangement will now be described. It is assumed that in a first stage, as a result of control pressure supplied from a circuit 45, the distributor 17 feeds the distributor 42 in the direction applying pressure to the hauling jack 11, and the distributor 53 is supplied in the direction effecting the clamping of the gripper hand 1. The machine is then moved away from the clamped gripper hand 1, while the unclamped gripper hand 2 slides towards the hauling jack 21. When the free piston 33 reaches the stop 36 of the sliding rod 34, its force overcomes the locking force of the rod, the rod 34 then operates the inversion distributor 17, which reverses the supply to the hauling jacks 11 and 21 simultaneously, that is to say then the hauling jack 21 is supplied. Supplies to the gripper hands are also reversed so that the gripper hand 2 is clamped and the hauling jack 21 then hauls itself forwardly, while the gripper hand 1 is unclamped and slides on the ramp. At the same time the circuit 42 again locks the sliding rod 34. It will be seen that as the hauling jacks 11 and 21 are directed in the same direction, as stated, the machine is hauled by alternating extensions in relation to each alternately clamped gripper hand until, on each operation the maximum extension of the active hauling jack is reached. If the manual selector 54 is operated, there is reversal of the clamping and unclamping of the gripper hands in relation to the action of the hauling jacks 11 and 21, and the machine will then be hauled by alternating retractions of the jacks in relation to the clamped gripper hand, which again leads to almost continuous movement of the machine, but in the opposite direction.

The invention has been described in connection with an embodiment relating to a mining machine which has to be hauled along a conveyor, such as an armoured conveyor. It can be applied to other types of self-propelled machines, for example machines which are to be clamped between the walls of a mine working, such as wedge type extraction machines provided with clamping means in the walls.

I claim:

1. A device for effecting translational movement of a machine comprising two anchoring elements for alternately supporting the machine, hauling jacks respectivey connected to the anchoring elements for hauling the machine, each hauling jack including a first hydraulic cylinder, a hydraulic connection for interconnecting the first cylinders in series, the first cylinders having the same effective volume, said hydraulic connection comprising a second hydraulic cylinder including a free-piston reciprocable therein, said second cylinder having at least the same effective volume as each of the first cylinders, a source of hydraulic fluid, means for hydraulically coupling said source to one of said first hydraulic cylinders for operating said hauling jacks in one direction, an end-of-stroke detector for detecting the end of a useful stroke of said free piston and means connected to said end-of-stroke detector for moving said coupling means to a position wherein the source is coupled to another of said first hydraulic cylinders for operating said hauling jacks in a direction opposite to said one direction.

2. A device according to claim 1, wherein the means for moving the coupling means is a central rod carrying stops for the free piston and mounted to slide between two stops, the rod passing axially through the second cylinder and the free piston and cooperating with self-locking abutment means.

3. A device according to claim 2, wherein the self-locking abutment means is operable to exert a force smaller than the opposed abutment support force of the free piston.

4. A device according to claim 1, wherein the coupling means is further connected to a means for controlling the operation, through a connecting pipe, of one or the other of the two anchoring elements in accordance with the operation of the hauling jacks.

5. A device according to claim 1, wherein each first cylinder includes a valve for communication between the chambers of the first cylinder and means for opening this valve at the end of the stroke of the hauling jack in the direction of the second cylinder.

6. A device according to claim 1, wherein a rod is reciprocable in the hauling jacks and connecting pipes controlling the anchoring elements respectively pass axially through the body and the rod of the hauling jacks.

7. A device according to claim 1, including means for reversing the control connections of the anchoring elements.

* * * * *